US007379554B2

(12) United States Patent
Sagren

(10) Patent No.: US 7,379,554 B2
(45) Date of Patent: May 27, 2008

(54) DRIVE UNIT FOR ELECTRO-ACOUSTIC CONVERTER WITH DUAL MAGNETIC CIRCUITS SHARING PERMANENT MAGNET

(76) Inventor: Anders Sagren, Leo Fenders Vag 1, Uppsala (SE) S-752 37

( * ) Notice: Subject to any disclaimer, the term of this patent is extended or adjusted under 35 U.S.C. 154(b) by 0 days.

(21) Appl. No.: 11/140,990

(22) Filed: Jun. 1, 2005

(65) Prior Publication Data

US 2005/0207601 A1 Sep. 22, 2005

Related U.S. Application Data

(62) Division of application No. 10/025,775, filed on Dec. 26, 2001, now Pat. No. 6,912,292.

(60) Provisional application No. 60/257,693, filed on Dec. 26, 2000.

(51) Int. Cl.
*H04R 25/00* (2006.01)

(52) U.S. Cl. ..... 381/182; 381/421

(58) Field of Classification Search ..... 381/182, 381/401, 402, 406, 412, 414, 421, 424
See application file for complete search history.

(56) References Cited

U.S. PATENT DOCUMENTS

| | | | | |
|---|---|---|---|---|
| 2,699,472 | A * | 1/1955 | Olson et al. | 381/186 |
| 3,665,124 | A * | 5/1972 | Sotome | 381/401 |
| 5,214,710 | A | 5/1993 | Ziegenberg et al. | |
| 5,786,741 | A | 7/1998 | Leibzon | |
| 6,269,168 | B1 * | 7/2001 | Tagami | 381/412 |

* cited by examiner

*Primary Examiner*—Suhan Ni
(74) *Attorney, Agent, or Firm*—Young & Thompson

(57) ABSTRACT

An electro-acoustic drive unit including at least a first and a second drive unit, each provided with a pole gap for exciting respective voice coil assemblies, at least one permanent magnet means is arranged to be a part of the magnetic circuit of both the first and the second drive unit. The pole gaps are arranged to provide magnetic fields directed radially with respect to a center axis of the loudspeaker, and the permanent magnet means has radially extending magnetization direction with respect to the center axis of the loudspeaker.

7 Claims, 8 Drawing Sheets

DRIVE UNIT FOR ELECTRO-ACOUSTIC CONVERTER WITH DUAL MAGNETIC CIRCUITS SHARING PERMANENT MAGNET

CROSS-REFERENCE TO RELATED APPLICATIONS

This application is a division of co-pending application Ser. No. 10/025,775, filed on Dec. 26, 2001, the entire contents of which are hereby incorporated by reference.

TECHNICAL FIELD OF THE INVENTION

The present invention relates electro-acoustic converters for sound reproduction, in particular, to compound loudspeaker drive units which have a multitude of functional units, are adapted to reproduce different part of the audio frequency spectra and are arranged in a co-axial and co-planar construction.

BACKGROUND OF THE INVENTION

In most loudspeaker system for reproducing a larger part of the audio frequency spectra at least two drive units are used. An example being a woofer used for reproduction of sounds in the low frequency bands and a tweeter used for the high frequency bands. The voice coils of the separate drive units are via a cross-over filter network connected to a power amplifier, which provide the electrical signals representing the sound to be reproduced. The purpose of the cross-over filter is to provide each drive unit with electrical signals corresponding to the audio frequency range each drive unit is designed to reproduce. The characteristics of the filter are arranged so that around a cross-over frequency, in an intermediate band, the output to the woofer tails off with increasing frequency and the output to the tweeter tails off with decreasing frequency. The cross-over filter can for example be passive or active, digital or analogue. Careful matching of the characteristics of the filter with the characteristics of the drive units has to be undertaken to achieve good sound reproduction.

The loudspeaker system may incorporate more than two drive units. A three way system with a tweeter, a mid range woofer and a woofer is a common loudspeaker construction. The matching cross-over filter will divided the electrical signal to the drive units having to characteristic cross-over frequencies and two intermediate bands. The for the following discussion important observation, is that a loudspeaker system with more than one drive unit, will have a least one audio frequency band in which the sound is generated by more than one drive unit.

The sound radiated from each of the drive units may be said to emanate from the apparent sound source or acoustic center of that unit; the position of the acoustic center is a function of the design of the particular drive unit an may typically be determined by acoustic measurements. In addition may the absolute position of the acoustic center be dependent on the frequency of the emitted sound. When separate loudspeaker drive units are used, such as in the common two- and three-way systems briefly described above, the acoustic centers will be physically displaced from each other. The drive units are usually mounted on a common baffle such that their acoustic centers lie in a common plane, but they are offset in a vertical direction in the plane of the baffle. For a listener positioned approximately in line with the axes of the loudspeaker drive units and approximately equidistant from the acoustic centers of both drive units, a desired balance of output from the two drive units can be obtained. However, if the position of the listener is moved from the equidistant position, the distances between the listener and the acoustic centers of the loudspeaker drive units will be different and hence sounds in the intermediate frequency bands produced by two drive units, will be received by the listener with a difference in time. This time difference between sounds received results in a phase difference between the sounds received at the listening position. The sounds from the two drive units no longer add together as intended in the intermediate band or bands; the resultant received sound will be disordered.

An area of particular interest are Public Announcement (PA) in for example auditoriums and concert halls. Modern premises are often constructed in a way that the room itself is virtually acoustically mute. A suitable PA system typically comprises a number of high-Q loudspeakers (commonly high-Q horns) arranged so that, in principle, each listener has a free line of sight to a loudspeaker. This will limit, but not completely eliminate, the problems caused by the phase difference. An alternative approach is to have a large multitude of small loudspeakers operating at moderate acoustic levels, distributed close to the listener. More problematic is to amplify sound in acoustically complex, non-mute, often older premises such as churches, theaters and concert halls. These reverberant halls are often constructed to amplify the human voice or the sound of instruments by a multitude of reflections of the sound waves in walls and ceilings. If conventional loudspeakers, with a phase difference between the different drive units, are used in such an environment, each reflection will double the phase difference. When the sound, after a multitude of reflections, reaches the listener it will be highly distorted. To damp the hall to obtain a near acoustic mute environment is in most cases not an attractive solution, since the acoustic character of for example a church is perceived as an essential part of the sound experience of such a premises.

A number of attempts have been made to overcome the undesirable effects originating from the displacement of the acoustic centers of the drive units. It is known to combine the low and high frequency loudspeaker drive units in a single compound co-axial construction. The compound co-axial loudspeaker drive unit consists of a generally conical low frequency diaphragm driven by a voice coil interacting with a magnetic structure that has a central pole extending through the voice coil. A high frequency diaphragm is positioned to the rear of the structure and sound output from this diaphragm is directed to the front of the loudspeaker drive unit by means of a horn structure extending co-axially through the center pole of the magnetic structure which interacts with the low frequency diaphragm. Thus both the low frequency and high frequency sounds are directed in a generally forward direction from the compound loudspeaker drive unit. In this co-axial form of loudspeaker construction there is no vertical or horizontal offset of the apparent sound sources for low and high frequencies. However the low frequency diaphragm is positioned at the front of the loudspeaker unit whereas the high frequency diaphragm is positioned at the rear of the loudspeaker unit and this results in relative displacement of the acoustic centers in the direction of the axis of the drive unit causing an undesirable time difference in the arrival, at the listener, of sounds from the high and low frequency diaphragms. More recent attempts are taught in for example U.S. Pat. Nos. 4,492,826 and 4,552,242 in which at least one smaller speaker is mounted co-axially above the larger speaker. Both share, to a non neglectable degree, the drawback of the above-describe construction of having a relative displacement of the acoustic centers in the direction of the axis of the drive unit.

A compound loudspeaker drive unit with a low frequency unit and a high frequency unit with their acoustic center coinciding in all three dimensions is described in U.S. Pat. No. 5,548,657 and is commercially available. A miniature, but of conventional type, tweeter has been provided in a recess provided in the center pole piece of the woofer. Due to the miniaturization of the tweeter its efficiency will constitute a limitation. (Complex and costly methods of cooling, for example with ferrofluids, will be necessary in order to achieve an acceptable level of efficiency.) Although superior to previously described constructions, also this compound loudspeaker shows a phase difference that makes it less suitable for use in a multiple reflection environment. In addition, the teaching of U.S. Pat. No. 5,548,657, is limited to a compound loudspeaker that has two drive units, and is not applicable if three or more drive units are required.

Thus, there is a need in the art for providing an electro acoustic converter providing a coherent wave-front for the emitted sound waves in a full frequency range, needed for accurate sound reproduction in multi-reflectional environments, and still have a high power efficiency. High power efficiency typically anticipates efficient cooling of the voice coils and permanent magnets.

SUMMARY OF THE INVENTION

One object of the present invention is to overcome the drawbacks of the prior art by providing a full frequency range compound drive unit having a point like apparent sound source, i.e. having the acoustic centers of the individual drive units coinciding in all three dimensions and combine the separate acoustic signals into a coherent wave-front thus converting the electrical signal with a high degree of accuracy and high efficiency.

Another object is to provide compound drive unit fully utilizing the advantages afforded by modern high performance magnetic material such as rare-earth based permanent magnets and extremely soft magnetic materials. In particular it is the object to utilize a design allowing for efficient cooling of the voice coils and permanent magnets.

Yet another object is to provide a loudspeaker system suitable for amplifying sound in environments characterized by a multitude of reflections of the sound waves, without substantially altering the character of the sound in such environment.

The above-mentioned objects are achieved by the device having the features according to claim 1. The objects are also achieved by the device having the features according to claim 12. A system for reinforcement of sound according to the invention is defined in claim 20.

Thanks to the inventive design of the magnetic structures makes it possible to achieve efficient drive units with a small diameter and thus overcoming the problems associated with prior art compound drive units.

Thanks to the system of the present invention it is possible to design amplifying systems capable of amplifying sound in reverberant environments without the drawbacks associated with prior art systems.

One advantage afforded by the present invention is that it provides electro acoustic converter providing a coherent wave-front for the emitted sound waves in a full frequency range. The coherence of the emitted sound waves does allow, for example, the use of (multiply) reflections for amplification of the sound.

Another advantage afforded by the present invention is that it provides a compound drive unit constructed according to a construction principle that allows more than two essentially co-planar and co-axial individual drive units.

Yet another advantage is that the compound drive unit in which the acoustic centers of the individual drive units can be easily adjusted relative each other along the direction of the axis of the drive unit, in order to minimize the phase difference between the individual drive units.

Yet another advantage is the inventive design allowing for efficient cooling of the voice coils and permanent magnets.

BRIEF DESCRIPTION OF THE DRAWINGS

The invention will now be described in detail with reference to the drawing figures, in which FIG. 1*a* schematically illustrates a cross sectional view of the magnetic circuits of an embodiment of the compound driver unit according to the present invention.

DETAILED DESCRIPTION OF THE INVENTION

Figure 1A:
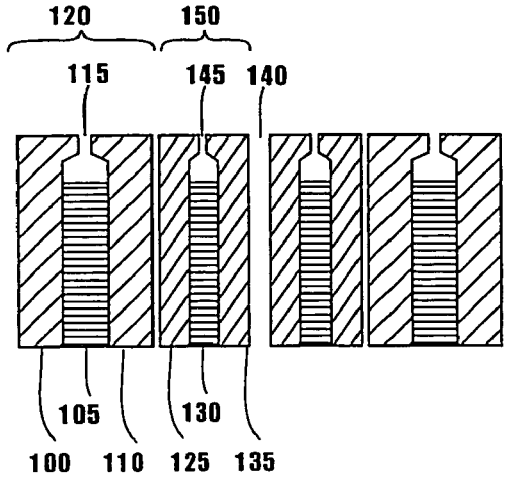
FIG. 1*b* shows the top view of the magnetic circuit of FIG. 1*a;*
FIG. 1*c* shows the bottom view of the magnetic circuit of FIG. 1*a;*
FIG. 1*d-e* schematically illustrates the compound driver unit comprising the magnetic circuit of FIG. 1*a;*
Figure 1B:
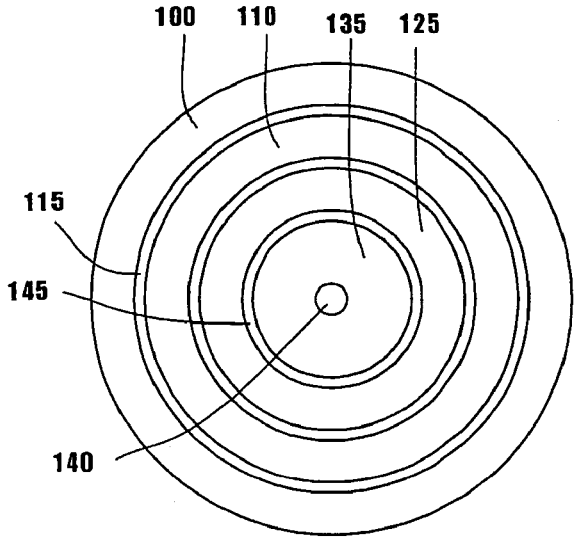
Figure 1C:
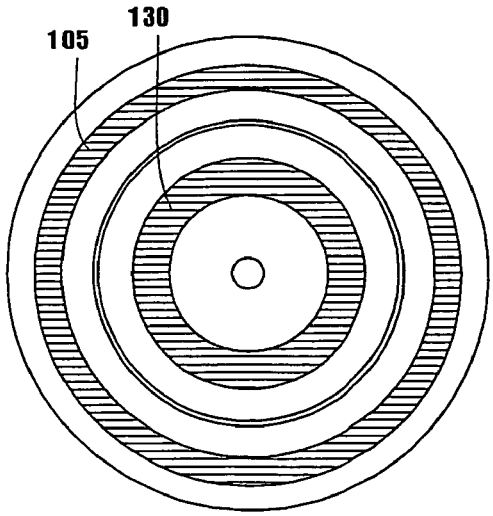

A first embodiment of the present invention will be described with reference to FIGS. 1*a-e*. Shown in FIG. 1*a-c* are the magnetic circuits of a compound drive unit comprising two individual drive units for low frequency and high frequencies, respectively. A first outer pole piece 100 substantially formed as a hollow cylinder provides a first cylindrical center chamber, and has part of its inner surface in metallic contact with the outer surface of a first permanent magnet 105 of substantially cylindrical shape. A first inner pole piece 110 substantially formed as a hollow cylinder is with part of its outer surface in metallic contact with the inner surface of the permanent magnet 105 and constitutes together with the first pole piece 100 a pole gap 115. The first outer pole piece 100, the first permanent magnet 105 and the first inner pole piece 110 provides the magnetic circuit of the low frequency drive unit 120. Localized in the interior of, and co-axially and substantially co-planar with, the first inner pole piece is a second outer pole piece 125 substantially formed as a hollow cylinder. The second outer pole is with part of its inner surface, in metallic contact with the outer surface of a second cylindrically shaped permanent magnet 130. In metallic contact with part of its outer surface to the inner surface of the second permanent magnet 130, is a second inner pole piece 135 formed as a cylinder and with a hole in its center, which is the center bore 140 of the compound drive unit. Together with the second outer pole piece 125, the second inner pole piece 135 forms a second pole gap 145. The second outer pole piece 125, the second inner pole piece 135 and the second permanent magnet 130 provides the magnetic circuit of the high frequency drive unit 150. In this embodiment of the invention magnetic flux is prevented between the low frequency magnetic circuit 120 and the high frequency magnetic circuit 150. The two magnetic circuits are fixed in a non-magnetic support structure 155 placed at the bottom surface of the magnetic structures (not shown in FIG. 1*a-c*) opposite the pole gaps. By way of the non-magnetic support structure the two magnetic support structures are magnetically separated.

As indicated in the figure, the inner and/or outer pole pieces may have annular protrusions to form pole gaps of suitable sizes. The permanent magnets 105,130 have radially oriented fields, i.e. one of the magnets pole is oriented towards the center axes of the drive unit and the other magnetic pole is oriented outwardly in the radial direction as seen in FIG. 1*c*. Hence, the outer pole pieces 100,125 connect to one pole of the permanent magnets 105,130 and the inner pole pieces 110,135 connect to the other pole. The magnetic fluxes guided by the pole pieces so as to provide a concentrated magnetic fields in the pole gaps 115 and 145, respectively. The permanent magnets are preferably of magnetic material with very high energy content such as rare-earth based compounds such as neodymium-iron-boron or samarium-cobalt. High performance permanent magnets are commercially available, for example Vacodym™ 510HR from Vacuumschmelze GmbH & Co. In order to transfer the magnetic flux to provide the necessary large static magnetic field in the pole gap, the pole pieces have to be manufactured from materials which are very easily magnetized, so called soft magnetic materials. Additionally, in order to optimize both the static magnetic properties and the shape of the hysteresis loop a proper selection of amorphous and nano-crystalline, sintered or laminated, materials has to be made. Extremely soft magnetic materials are today commercially available, for example Vacofer™ S1 or Vacoflux™ from Vacuumschmelze GmbH & Co. Thanks to the inventive design of the magnetic structures makes it possible to achieve efficient drive units with a small diameter and thus overcoming the problems associated with prior art compound drive units.

Figure 1D:
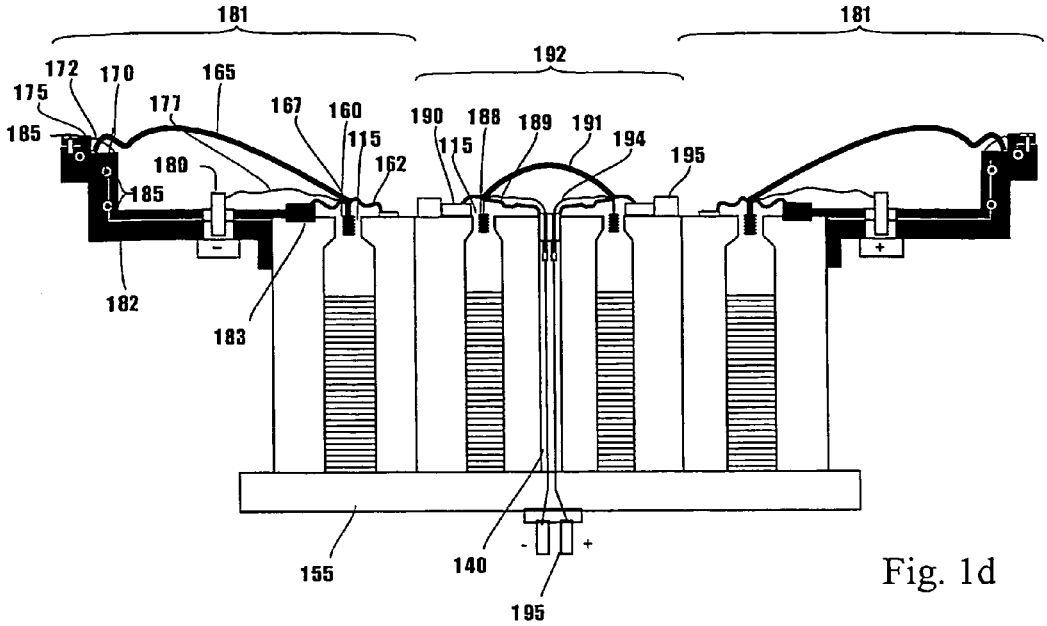

In FIG. 1*d* the magnetic structures are shown in cross section in combination with other members necessary to form an electro-acoustic converter. A low frequency voice coil 160 is held in the low frequency pole gap 115 by suspensions 162 and is connected to one end of a low frequency diaphragm 165 via a flexible moulding 167. The other end of the low frequency diaphragm 165 is via a suspension 170 and a flexible moulding 172 connected to an annular support unit 175. The voice coil 160 is connected to electrical leads 177 which terminate in an electrical terminal 180 adapted to be connected to a non-shown cross-over filter. As illustrated in FIG. 1*d* the above described low frequency driver unit members are contained in a detachable assembly 181, which is arranged to interact with a main chassis unit 182. The voice coil 160 is with precision centered in the pole gap 115 by means of flanges 183 and the therein contained O-rings and structure is held in position with the mounting flange 185 and O-rings 184. The ability to have an easily detachable voice coil and diaphragm assembly is afforded by the novel design of the magnetic structure, but the invention can equally well be utilized with a fix voice coil and diaphragm structure.

Figure 1E:
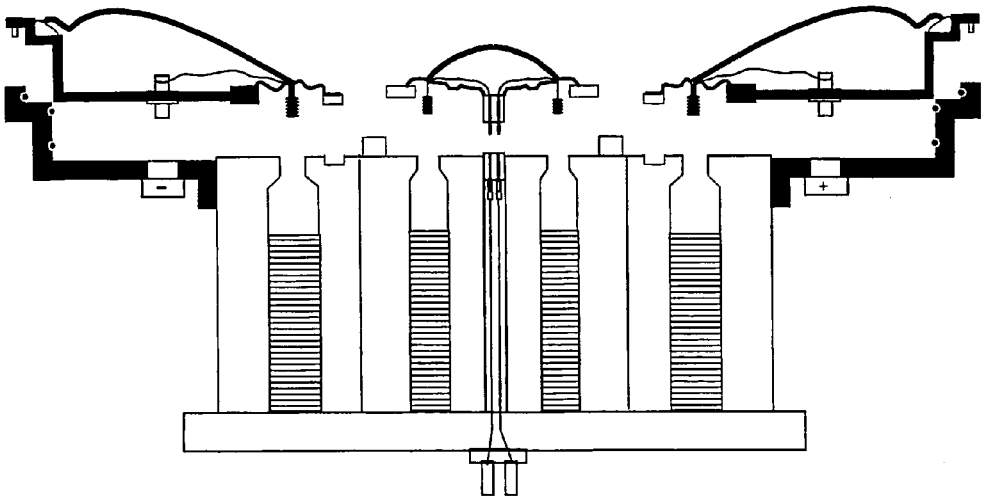

The illustrated high frequency drive unit is of tweeter type. A high frequency voice coil 188 is suspended by a suspension 189 in connection to an annular support unit 190. The voice coil is connected to a dome shaped high frequency diaphragm 191. The electrical signal is fed to the high frequency voice coil via electrical leads 194 which preferably pass through the center bore and terminate in a terminal 195 similar to the low frequency electrical terminal 180. The high frequency voice coil and diaphragm assembly 192 can be, similar to the low frequency carrier assembly 181, but does not have to be, made detachable from the magnetic structure. A flange 195 and an O-ring securely and accurately position the high frequency voice coil in the pole gap 145. The low frequency voice coil and diaphragm assembly 181 do together with the low frequency magnetic circuits 120 make up the low frequency drive unit 105, and the high frequency voice coil and diaphragm assembly 192 do together with the high frequency magnetic circuits 150 make up the high frequency drive unit 110. As shown in FIG. 1*d-e* all parts of the low frequency drive unit 105 are separated from the parts of the high frequency drive unit 110. The individual driver units, or parts of them, can be removed and mounted independently. This modular construction will make it possible to remove the entire individual drive unit or for example the voice coil and diaphragm structure of either one of the drive units in the case of repair work or replacement.

The efficiency of a drive unit is highly dependent on the strength of the magnetic field in the pole gap. The magnetic structure according to the above-described preferred embodiment of the invention take full advantage of the magnetic properties provided by rare-earth based permanent magnets and the magnetically soft alloys. In principle the structures could be realized with traditional magnetic materials such as ferrite permanent magnets and cast iron, but the magnetic field in the pole gap would be weak and hence the efficiency of the compound drive unit would be very low. Hence, modern high performance magnetic material is a prerequisite for an effective realization of the invention; at the same time does the inventive design of the magnetic structures create the necessary conditions to fully utilize the advantages of the high performance magnetic materials. This is achieved by providing means for effective cooling of the voice coils. The voice coils produces heat when electrical current is fed through the coil. The heat generation can be quite substantial and do effect both the coil itself and other members of the drive unit. Modern high performance permanent magnets, such as Neodymium-Iron-Boron are particularly sensible to high temperatures. Already at fairly moderate temperatures, typically around 60° C., they start to loose their high coercivity, and typically above 80° C. the performance is irreversibly damaged.

Figure 2A:
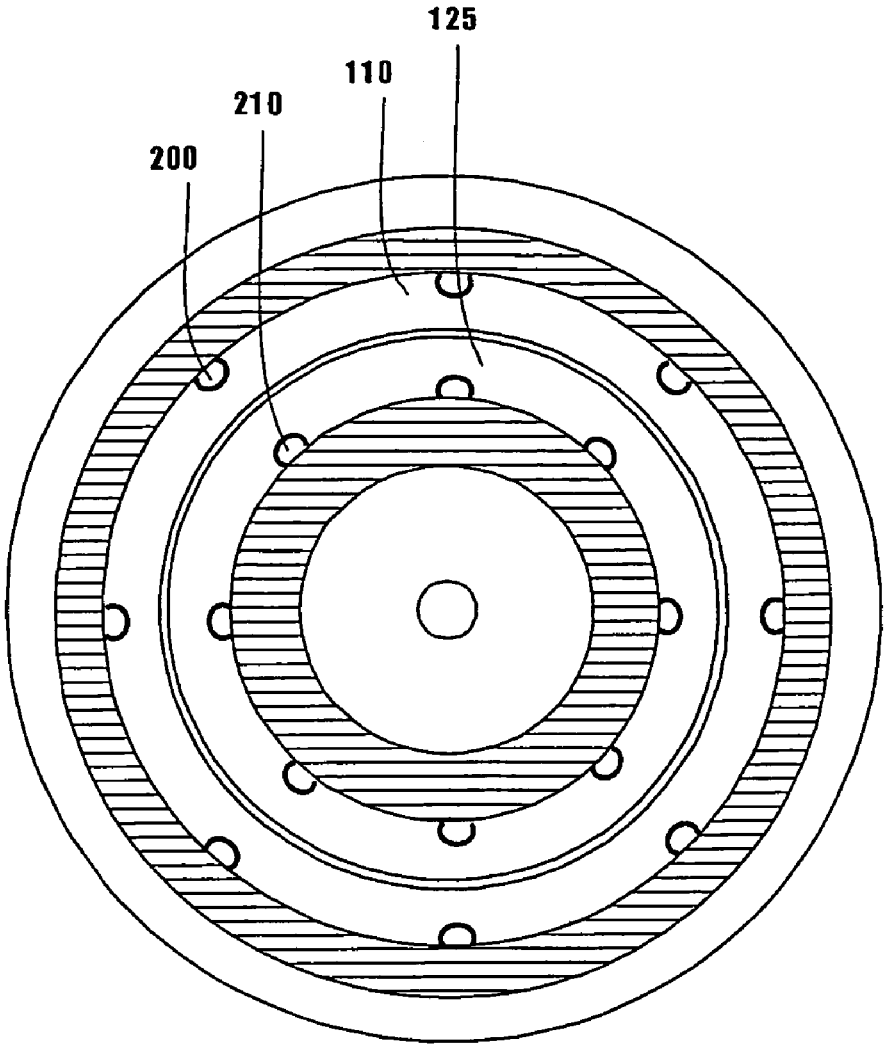
FIG. 2*a-b* schematically illustrates the cooling air ducts according to one embodiment of the present invention.
Figure 2B:
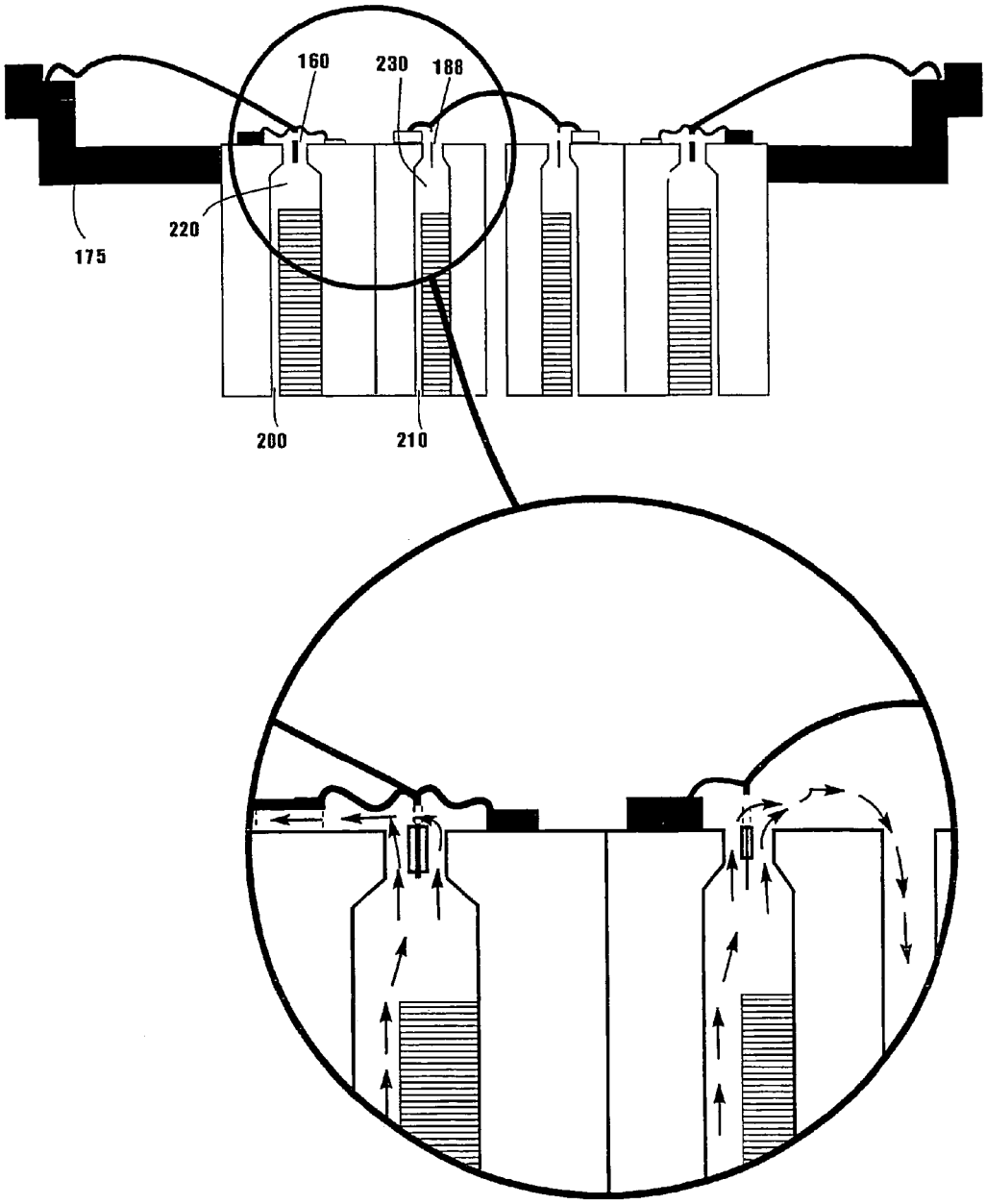

In the embodiment of the invention illustrated in FIG. 2*a* and *b*, the pole pieces has been provided with air ducts 200, 210. The air ducts 200, 210 are examplary drilled holes in the pole pieces 110 and 125, respectively, localized adjacent to the permanent magnet 105,130. Air ducts leads from cavities 220, 230, formed beneath the pole gaps by the outer pole pieces 100,125 the permanent magnets 105,130 and the inner pole pieces 110,135 to the rear side of the magnetic structure. The openings of the air ducts 200, 210 at the rear side of the magnetic structure corresponds to openings provided in the non magnetic support structure 21. The air ducts will make it possible for air to flow, as indicated with arrows in the figure, through the openings in the support structure, via the air ducts 200, 210 and the cavities 220, 230 and around the voice coils 160, 188. In the low frequency drive unit the air is let out or discharged, through openings in the annular support member 175. In the high frequency drive unit of tweeter type, the cooling air can be lead through the center bore 140. If needed, forced ventilation can be utilized by providing a fan. As the skilled in the art will appreciate the air ducts as well as the means for forced ventilation around the voice coils 160, 188 can be provided in a number of ways. The size and number of the air ducts should be designed with consideration of the needed cooling effect. Care has also to be taken not to substantially impede the magnetic flux in the pole pieces, which could negatively effect the strength of the magnetic field in the pole gaps.

Figure 3A:
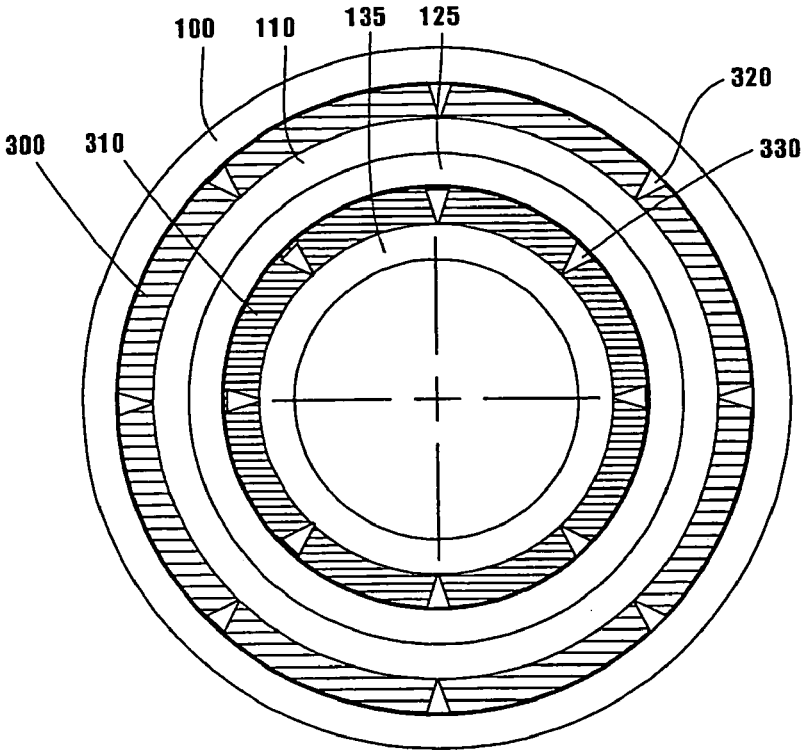
FIG. 3*a-b* schematically illustrates the bottom view of the magnetic circuits according to alternative embodiments of the present invention.

The permanent magnets do not need to be continuous and cylindrically shaped. In a preferred embodiment of the invention, depicted in FIG. 3*a*, a plurality of permanent magnet bars are used to provide the important magnetic fields in the pole gaps. The first inner pole piece 110 is, on its outer surface, connected to a first set of a plurality of permanent magnet bars 300 with an arched cross section. The permanent magnet bars 300 have radially extending magnetization directions with respect to the center axis of the loudspeaker. The first set of magnet bars 300 are on the opposite side in the radial direction connected to the first outer pole piece 100. The first inner pole piece 110, the first set of magnet bars 300 and the first outer pole piece 100 forms the low frequency magnetic circuit 120 and provides the first pole gap 115 for receiving the magnetic coil of the low frequency diaphragm assembly 181. Likewise, the second inner pole piece 135, is on its outer surface, connected to a second set of a plurality of permanent magnet bars 310 with an arched cross section, with radially extending magnetization directions. The second set of magnet bars 310 are on the opposite side in the radial direction connected to a second outer pole piece 125. The second inner pole piece 125, the second set of magnet bars 310 and the second outer pole piece forms the high frequency magnetic circuit 150 and provides the second pole gap 145 for receiving the magnetic coil of the high frequency diaphragm assembly 192. The high frequency magnetic circuit 150 is arranged to fit in the cylindrical center chamber of the first inner pole piece 110. In this embodiment of the invention the air ducts 320, 330 for cooling the magnetic coils are provided between the permanent magnet bars. In addition does this embodiment provide symmetrical magnetic fields in the pole gaps which further improves the sound reproduction.

Figure 3B:
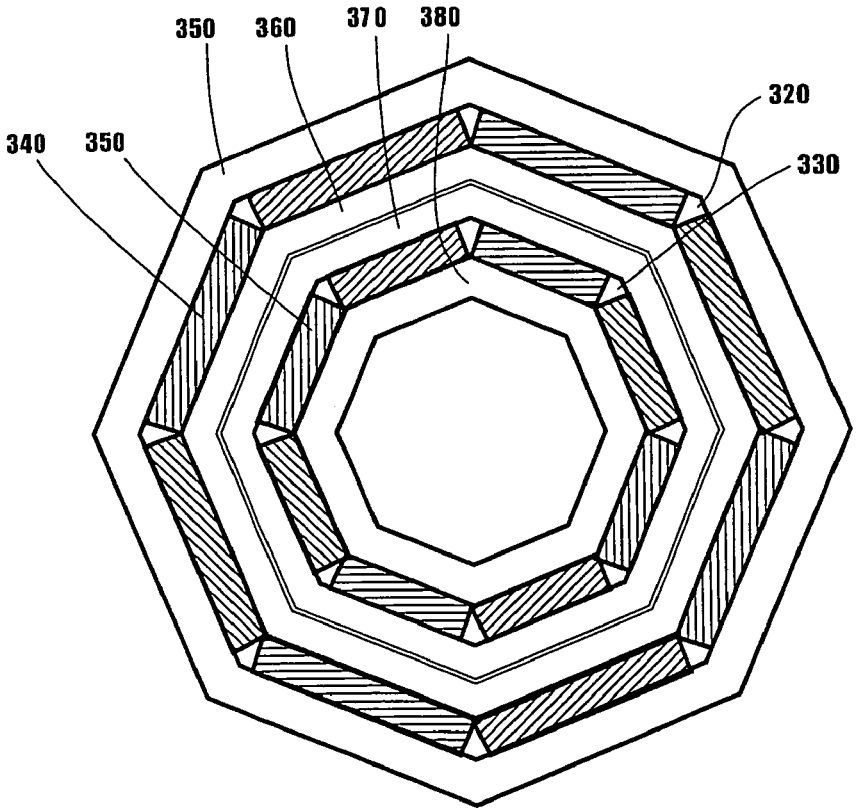

In an alternative embodiment, depicted in FIG. 3*b*, permanent magnetic bars 340 with rectangular cross section are used in the magnetic structure. The pole pieces 350, 360, 370, 380 will then at the rear side have a polygonal geometry. The pole gaps (front side) are as before circular. The openings 320, 330 formed between the individual plane magnets can also in this alternative embodiment be utilized as the cooling air ducts. As appreciated by the skilled in the art, a large variety of geometrical shapes of the permanent magnet bars, and hence of the pole pieces, can be utilized. However, in the design of the magnetic circuits, care has to be taken to achieve uniform and sufficiently large magnetic field in the pole gaps.

Figure 4:
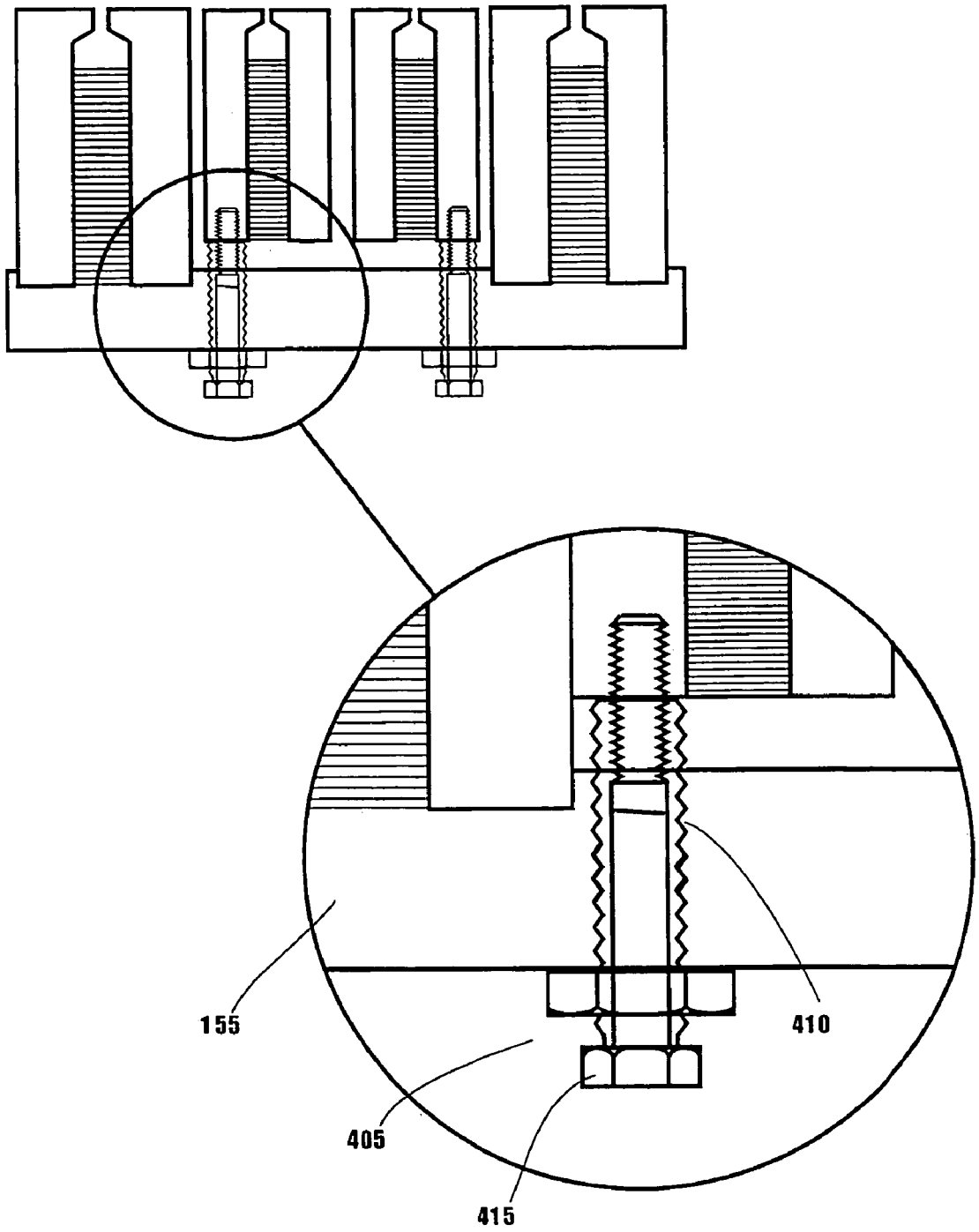
FIG. 4 schematically illustrates the means for adjusting the acoustic centers of the individual driver units according an embodiment of the present invention.

A further embodiment of the invention utilizes the fact that the magnetic structures of the individual drive units are independent of each other. The acoustic center of a drive unit does not necessarily need to lie in the same plane as the voice coil and can be difficult to determine without careful measurements. The design according to the invention does give the possibility of adjusting the individual drive units co-axially relative to each other. This way a minimization of the phase difference between the individual drive units is achieved. The adjustment can be done at the design stage of the compound drive unit, and it is also possible to provide the support structure with adjustment means for later adjustments of the acoustic centers relative position. Adjustment means can, as appreciated by the skilled in the art, be provided in a number of ways. An exemplary embodiment is depicted in FIG. 4, where the support structure 155 has been provided with a plurality of adjustment means 405, allowing a co-axial adjustment of the individual driver units relative each other. The adjustment means 405 comprises a outer hollow screw 410 which interact with the support structure and an inner screw 415 which tightly secures the driver units.

Figure 5A:
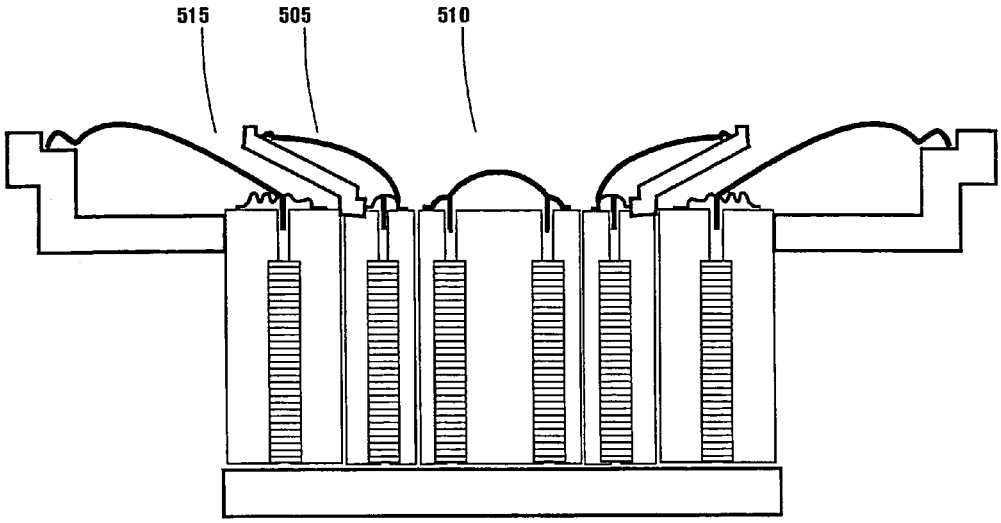
FIG. 5*a-b* schematically illustrates the compound driver unit comprising three individual driver units according to an embodiment of the present invention.
Figure 5B:
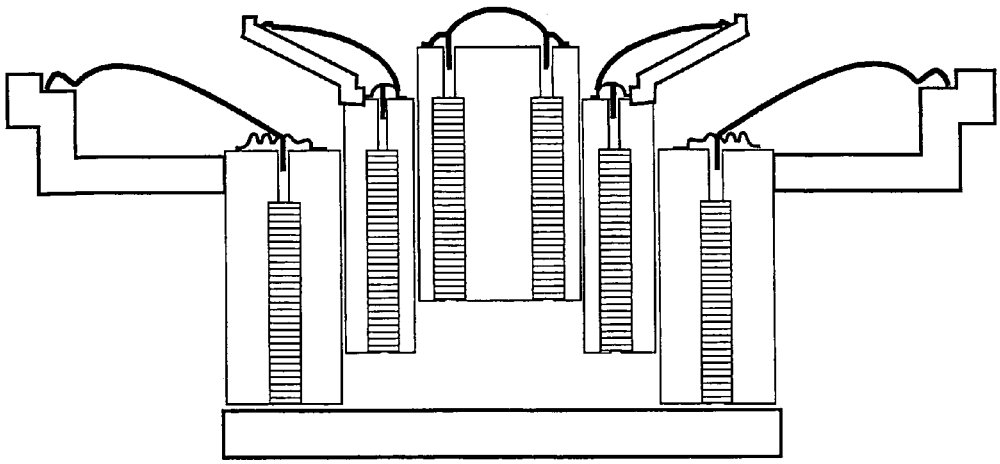

The compound loudspeaker according to the invention has hitherto been exemplified with two individual drive units, corresponding to a conventional two-way loudspeaker assembly. A unique feature provided by the invention, is the ability to combine three or more individual drive units into a co-planar and co-axial compound drive unit. An embodiment of the invention, comprising three individual drive units is shown in FIG. 5. A medium frequency range drive unit 505 is provided in between the high frequency (tweeter) drive unit 510 and the low frequency drive unit 515. The medium frequency range driver unit is designed analogue to the above described low frequency driver unit. Like the compound assembly with two driver units, also the compound assembly with three driver units can, by adjusting the relative axial position of the individual driver units, be made to have the acoustic centers of the three driver units coincide. This is indicated in FIG. 5*b*.

The ability afforded by the invention, to careful adjust the relative axial position of the drive units, either at the manufacturing stage or at a later stage by adjustment means, ensures a high accuracy electro-acoustic conversion. A commonly used method to measure of the accuracy of the conversion is to have the acoustic signal reflected a number of times and compare the resulting multiply reflected signal with the original signal. The signal from a conventional loudspeaker assembly would already after the first reflection be highly distorted (the Rapid Speech Transmission Index, RASTI goes from 0.9 to 0.4). Corresponding measurement with a compound driver unit according to the invention shows that after three to four reflections the signal is only marginally affected (corresponding to a RASTI value of approximately 0.7).

Figure 6:
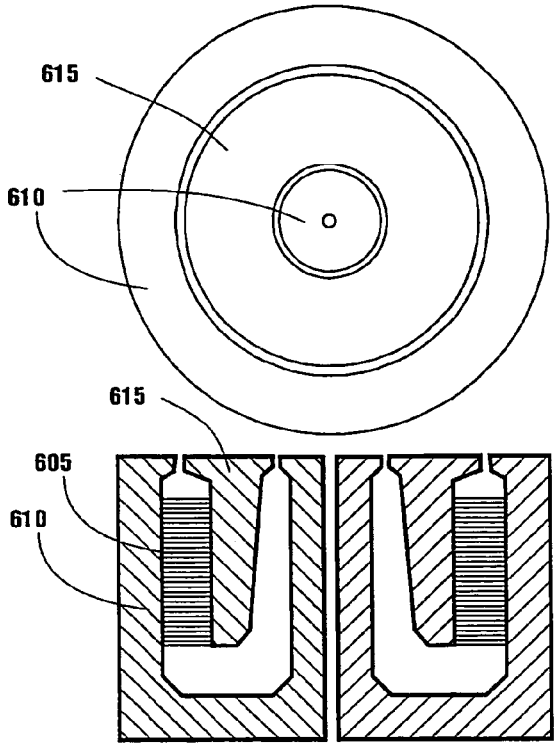
FIG. 6 schematically illustrates a cross sectional view of the magnetic circuits and the top view of an embodiment of the compound driver unit according to the present invention.

A further embodiment of the invention, utilizes a common permanent magnet for both the low and high frequency drive units. The magnetic circuits of this embodiment are shown in FIG. 6. A common permanent magnet 605, which has its magnetic field radially oriented, has its outer pole in magnetic contact to a first common pole piece 610. The first pole piece 610 is preferably essentially U-shaped, the outer part making up the outer pole piece of the low frequency driver unit, and the inner part making up the inner pole piece of the high frequency driver unit. The inner pole of the permanent magnet 605 is in contact with a second common pole piece 615. The second common pole piece 615 becomes the inner pole piece of the lower frequency drive unit and the outer pole piece of the high frequency unit. The coils and diaphragms can be mounted in accordance to the previously, with references to FIG. 1, described compound driver unit.

Alternatively two permanent magnets are used as in previous embodiments but with one pole piece shared between the two driver units. In comparison with the embodiment depicted in FIG. 1 the first inner pole piece 110 and the second outer pole piece 125 would be combined to a single shared pole piece contributing to both of the pole gaps.

Figure 7:
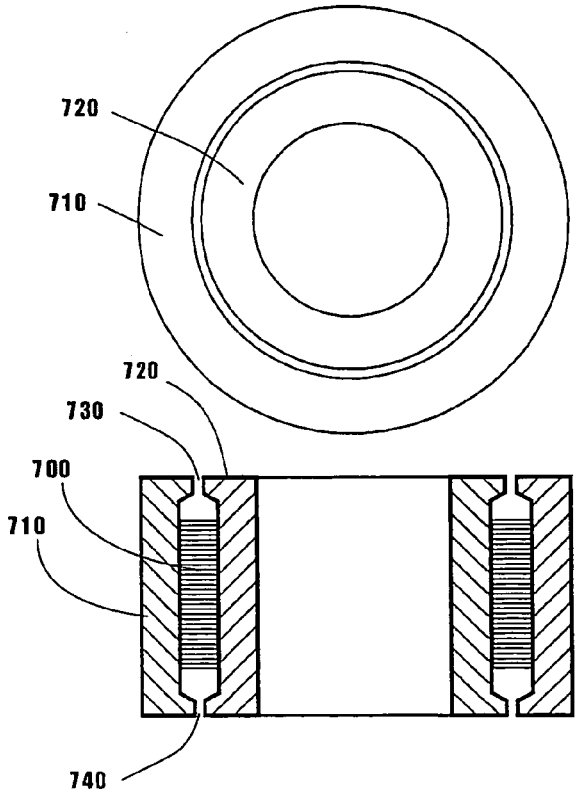
FIG. 7 schematically illustrates a cross sectional view of the magnetic circuits and the top view of an embodiment of the compound driver unit according to the present invention.

An alternative embodiment of the inventive design utilising radially directed magnetic fields in the permanent magnets, is shown in FIG. 7. A permanent magnet 700 is on its outer and inner surface in magnetic contact with outer and inner pole pieces, 710 and 720, respectively. The pole pieces forms, similar to previous embodiment, a first pole gap 730. In addition, the pole pieces 710 and 720 form a second pole gap 740 on the opposite side of the permanent magnet in the direction of the centre axis of the driver unit. Equipped with suitable coils and diaphragms a compound driver unit with two identical counter-directed individual driver units, sharing the same magnetic circuit, is achieved. The compound driver unit can advantageously be utilized e.g. in low frequencies applications, so called subwoofers.

The invention, with the embodiments described, provides a point-like source of sound, i.e. the acoustic centers of the individual drive units do all coincide in one single point, and thus, provides the possibility to improve the sound reproduction in e.g. home stereo equipment and makes it particularly suitable for use in public premises with acoustically complex behavior. In a typical PA-arrangement a speaker addresses an auditorium in a reverberant hall. The voice of the speaker is reinforced by a microphone in connection with amplifying means which through a cable is connected to a compound loudspeaker assembly, comprising the compound driver unit of the present invention, filter circuits, cable connectors etc. housed in a loudspeaker housing. To preserve the characteristic sound of the hall, as well as to preserve the sense of the direction of the sound, the loudspeaker assembly is typically arranged close to the speaker. Due to the superior efficiency of the compound driver unit of the present invention, the amplifying means can output a very moderate power, and only one or a few loudspeaker assemblies are needed to give a considerable volume of sound. However, if needed to achieve the desired volume of sound a larger number of loudspeaker assemblies can be used.

The coherent wavefront over a large frequency region afforded by the present invention, makes it possible to use a large number of compound driver units combined in large arrays without the drawbacks associated with such arrangements using conventional loudspeakers. The coherence of the compound driver units also enables use of electronic control of the dispersion of the combined sound-field, e.g. for controlling the beam forms in a manner similar to beamforming of electromagnetic waves with multielement antennas. Similarly provides the point-like source of the sound and the coherent soundwave, new possibilities in amplifying and directing the sound with reflectors.

The compound drive unit according to the invention has been described with the magnetic structures, voice coils and diaphragms being essentially circular in a plane perpendicular to the drive unit center axis. As the skilled in the art will appreciate any of the shapes common in loudspeakers, e.g. elliptical can be utilized in the inventive design according the invention. It should also be noted that the design utilizing magnetic bars, described with reference to FIG. 3 advantageously can be utilized in all embodiments here described.

From the invention thus described, it will be obvious that the invention may be varied in many ways. Such variations are not to be regarded as a departure from the spirit and scope of the invention, and all such modifications as would be obvious to one skilled in the art are intended for inclusion within the scope of the following claims.

The invention claimed is:

1. A compound electro-acoustic drive unit comprising:

at least a first and a second drive unit, each provided with a pole gap for exciting respective voice coil assemblies, wherein, at least one permanent magnet means is arranged to be a part of a magnetic circuit of both the first and the second drive unit, said pole gaps arranged to provide a magnetic field directed radially with respect to a center axis of the loudspeaker, and said permanent magnet means having a radially extending magnetization direction with respect to said center axis of the loudspeaker.

2. The compound electro-acoustic drive unit according to claim 1, wherein the first and second drive unit have at least one common permanent magnet means, and an outer pole piece of the first drive unit is in magnetic contact with an inner pole piece of the second drive unit, and an inner pole piece of the first drive unit is in magnetic contact with an outer pole piece of the second drive unit.

3. The compound electro-acoustic drive unit according to claim 2, wherein the permanent magnet means is an assembly of a plurality of permanent magnet bars.

4. The compound electro-acoustic drive unit according to claim 1, wherein the permanent magnet means is on its outer surface in magnetic contact with an outer pole pieces and on its inner surface in magnetic contact with an inner pole piece, said pole pieces essentially shaped as hollow cylinders and forming a first and a second counter-directed pole gaps in the end of the cylinders.

5. The compound electro-acoustic drive unit according to claim 4, wherein the first and a second counter-directed pole gaps are essentially identical.

6. The compound electro-acoustic drive unit according to claim 5, wherein the compound driver is adapted for low frequencies applications, so called subwoofers.

7. The compound electro-acoustic drive unit according to claim 4, wherein the permanent magnet means is an assembly of a plurality of permanent magnet bars.

* * * * *